United States Patent [19]

Wilke

[11] 3,938,734

[45] Feb. 17, 1976

[54] CONTROLLING SYSTEM FOR THE DISPLACEMENT OF THE SPECIFICALLY LIGHTER LIQUID COMPONENTS FROM A SELF-EMPTYING SEPARATOR

[75] Inventor: Friedrich Wilke, Oelde, Germany

[73] Assignee: Westfalia Separator AG, Oelde Westfalen, Germany

[22] Filed: Dec. 12, 1974

[21] Appl. No.: 532,134

[30] Foreign Application Priority Data

Dec. 21, 1973 Germany ..... 2363741

[52] U.S. Cl. ..... 233/20 R; 233/20 A

[51] Int. Cl.[2] ..... B04B 1/14; B04B 11/00

[58] Field of Search ..... 233/19 R, 19 A, 20 R, 20 A

[56] References Cited

UNITED STATES PATENTS

| | | | |
|---|---|---|---|
| 3,445,061 | 5/1969 | Nilson | 233/20 R |
| 3,593,915 | 7/1971 | Steinacker | 233/20 A |
| 3,623,657 | 11/1971 | Trump | 233/19 A |

*Primary Examiner*—George H. Krizmanich

*Attorney, Agent, or Firm*—Burgess, Dinklage & Sprung

[57] ABSTRACT

Control unit for a self-emptying centrifuge having a fluid controlled emptying valve for discharging the solids and a paring disc or a conduit sealingly joined to the drum for removal of a specifically heavier liquid and an outlet for a specifically lighter liquid, for displacement of the specifically lighter liquid from the drum before the emptying valve is opened. The control unit operates so that flow in the outlet for specifically heavier liquid is reduced whereby specifically lighter liquid is displaced from the centrifuge, and so that thereafter the emptying valve is opened.

4 Claims, 1 Drawing Figure

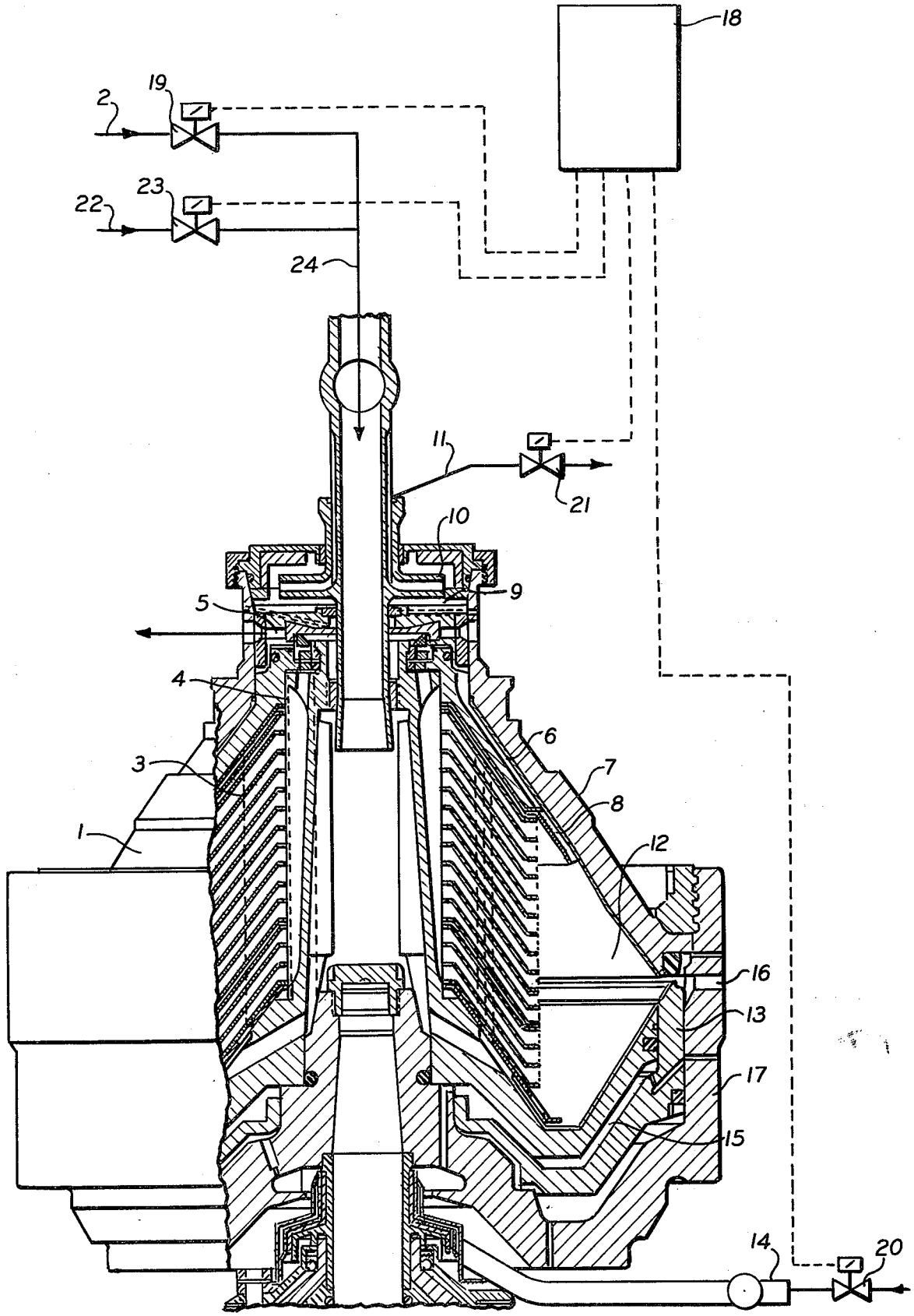
18
19
2
23
22
24
11
21
10
9
5
4
6
3
7
8
1
12
16
13
17
15
14
20

CONTROLLING SYSTEM FOR THE DISPLACEMENT OF THE SPECIFICALLY LIGHTER LIQUID COMPONENTS FROM A SELF-EMPTYING SEPARATOR

BACKGROUND

The invention relates to a control system for the displacement of the specifically lighter liquid components from a self-emptying separator from which at least the specifically heavier liquid component is carried out by means of a paring disk or through a conduit sealingly joined to the drum, in which conduit a throttling means is installed. This displacement takes place before the ejection apertures in the periphery of the drum are opened for the ejection of the solids separated from the liquid mixture. In this manner the loss of the specifically lighter useful liquid that is still in the drum is avoided.

For the operation of the necessary valves and the control of the required waiting periods, control systems are used almost always. Such a control system is known from German Pat. No. 1,142,795, for example.

In clarifying separators which centrifugally separate only the solid impurities from liquids consisting of one or more phases, without at the same time separating mixtures of liquids into their components, the displacement of the liquid filling the central portion of the drum is relatively simple. Drums of this kind have only one liquid outlet. After the solids chamber is filled and it is desired to empty the drum completely, first the raw liquid feed valve is closed and then the inlet is changed over to a specifically heavier displacement liquid. This valve is kept open by the control system until the useful liquid has been displaced inwardly out of the drum. The necessary amount of displacement liquid is approximately equal to the capacity of the drum minus the volume of the solids chamber.

If the clarified liquid is carried away by a paring disk or a conduit hermetically joined to the drum, a valve in this conduit must be closed before the valve is opened which controls the hydraulic fluid which causes the discharge apertures to be opened for the ejection of solids. This prevents losses due to the reverse flow of useful liquid into the drum during the emptying process. After the drum has been emptied, all valves must be restored to their original state in reverse order.

In centrifugal separators which, in addition to removing specifically heavier solids, separate the mixture of liquids into its components, the displacement of the specifically lighter liquid components constitutes a problem. Also, such displacement is involved only when the specifically lighter liquid is the useful component. The raw liquids involved include, for example, fishpresswater, or oils contaminated with solids and water. Centrifugal separating drums have two liquid discharges for the separated components. Their distance from the axis of rotation is normally so adjusted that the separation zone is located within the ascending passages of the plate stack. To displace the specifically lighter liquid components out of the drum, the separation zone must be shifted to the inner liquid level.

In centrifugal separators having a free discharge for both of the liquid components through regulating disks, the position of the separation zone is determined by the inside diameter of the regulating disks in accordance with the difference in the density of the two components. At a normal throughput, it can be changed only by replacing at least one disk with the separator shut down. If the amount of the specifically heavier component greatly exceeds that of the lighter, a displacement of the separation zone towards the inside can accomplished during operation by increasing the infeed to such an extent that more of the specifically heavier liquid enters the drum per unit of time than can pass out over the regulating disk. For this purpose, however, a considerable increase of the input is necessary because very great flows of liquid can pass out over the regulating disk. Exceeding the rated capacity of the drum to such an extent, however, signifies an appreciable reduction of the clarifying performance, so that a portion of the solids becomes entrained in the flow of liquid. This method fails where a plurality of self-emptying separators are operated in parallel. In the case of central control by a single control apparatus, the greatly exceeded nominal capacity would be simultaneously signaled for all separators, which the pump or the cross section of the main supply line, being set for normal throughput, will not provide. But even in the case of the individual control of the individual separators this can happen when several control apparatus coincidentally signal for the increased capacity. Besides, this method is not practicable in the case of raw liquids in which the specifically heavier component is contained in only small amounts. In such cases it is indeed possible to take specifically heavier liquid from a storage tank or also to mix a specifically heavier foreign liquid, in the quantity required for the shifting of the separation zone, with the raw liquid being fed in, or to feed it separately into the drum. However, the unreliability and disadvantages would be the same as in the case of the increase in the input of raw liquid.

In the case of self-emptying separators in which the separated components are removed by means of paring disks, and self-emptying separators of the hermetic or semihermetic type of construction, the increase of the input is also problematical. In drums of this kind, however, the position of the separation zone can be shifted during operation by varying the back pressure by means of a throttling member in at least one of the two discharge lines.

German Pat. No. 659,724 discloses a cream separator from which the cream and the skim milk are removed by means of a paring disk, and in which a throttling means is installed in each of the two discharge lines. The throttling members serve for the adjustment of the back pressure in order to achieve the depth of immersion of the paring disks that is necessary for froth-free removal, and, in the separation of whole milk, to establish the desired ratio of cream and skim milk, i.e., to set the separation zone at the desired position. After the adjustment has been made the throttling members remain unchanged.

THE INVENTION

The inventon relates to self-emptying centrifugal separators from which at least the specifically heavier liquid component is carried out by means of a paring disk or by a conduit sealingly joined to the drum, in which conduit a throttling means is installed. The removal of the specifically lighter component can be accomplished by any desired means.

The object of the invention is to devise a control system for the purpose, in drums of this kind, of displacing the specifically lighter useful component from the drum prior to the opening of the ejection apertures on the periphery of the drum, without requiring an increase of the input or the feeding of a larger amount of displacing liquid.

The control system of the invention is characterized in that the throttling means installed in the line for the removal of the specifically heavier component can be changed from the operating setting to a greatly throttled setting or to an absolute shut-off setting by the control apparatus and is held in this setting until the specifically heavier component has shifted the separation zone as far as the inner level of liquid, after which the control apparatus shuts off the feed and operates the valve in the line carrying the control liquid. When the discharge is closed or throttled down, the specifically heavier liquid remaining in the drum builds up towards the axis of rotation and pushes the specifically lighter liquid ahead of it to the discharge thereof. This control system can be used always, regardless of whether the specifically heavier component constitutes the greater or smaller proportion of the mixture. If it constitutes the smaller proportion, the complete closing of the valve is recommended; if it constitutes the greater proportion, throttling down will suffice.

For complete displacement of the specifically lighter component with the discharge completely shut off, no more of the specifically heavier liquid is required than corresponds to the volume occupied in the drum by the specifically lighter liquid. The duration of the operation, which is to be preset in the control apparatus, is computed on the basis of this volume and the amount of specifically heavier liquid that is retained in the drum or fed to the drum per unit of time.

An embodiment of the invention wherein the specifically heavier component is removed using a paring disc is shown in the accompanying drawing. The invention could similarly be practiced with a separator wherein the specifically heavier component is removed using a conduit sealingly joined to the drum as is disclosed in British patent specification No. 476,823.

The invention will now be further explained with the aid of the drawing. 1 represents the separating drum to which the liquid mixture to be clarified and separated is fed through line 2. During operation, the separation zone of the two liquid components is at 3 and the free level of the specifically lighter component is at 4. In this embodiment the specifically lighter liquid leaves the drum through radial bores 5. The specifically heavier liquid component flows through the annular passage 6 between the drum cover 7 and the separating plate 8 to the paring chamber 9 from which it is taken by means of a paring disk 10 and discharged under pressure through line 11.

When the solids chamber 12 of the drum is filled with solids, the slide valve 3 is shifted to the open position, in which it is shown, by feeding a hydraulic control fluid through line 14 to the opening chamber 15, so that the entire content of the drum is ejected through apertures 16 in the drum periphery 17. The drum can also be constructed such that the flow of a hydraulic control fluid must be interrupted in order to empty the drum. In any case, valve 20 in line 14 carrying the control fluid must be operated.

To prevent losses of specifically lighter useful liquid, the latter must be displaced from the drum to its outlet 5, before the ejection apertures 16 are opened. This is accomplished when the control apparatus 18 greatly throttles or completely shuts off valve 21 in discharge line 11 carrying the specifically heavier liquid component, before the feed line 24 is shut off, through the closing of valve 19 in line 2, and before the operation of valve 20 in the control fluid line 14. The volume of liquid to be displaced is relatively small, so that the displacement is rapidly completed without increasing the input rate of flow. In many cases, it does not matter if a portion of the displacing liquid enters into the outlet of the specifically lighter liquid since an additional separator is used to improve the purity of the latter. Through line 22 a specifically heavier foreign liquid can be fed into the drum as a displacing liquid. In this case, before or simultaneously with the operation of valve 21, the feed line 24 is to be changed over from source 2 to source 22 by closing valve 19 and opening valve 23.

Control unit 18 is a timing device. Upon or following actuation thereof by manual operation of a switch or by another control apparatus, when it is desired to empty the separator, initially valve 21 is operated. At a fixed time interval thereafter, which can be readily calculated from the dimensions of the drum and known operating conditions, or can be determined experimentally, control unit 18 operates valve 20. At same time valve 20 is actuated, the control unit shuts off valve 19. If displacement fluid is used, the control unit 18, upon actuation thereof, can further operate to close valve 19 and open valve 23. In a simple case the operation can be without feeding a foreign displacement fluid and following a fixed interval after operation of valve 21, the control unit 18 can simultaneously operate valve 20, and close valve 19.

SUMMARY

Thus, the invention provides a self-emptying centrifuge suitable for separating a feed material into a specifically heavier liquid, a specifically lighter liquid, and a solids component. The centrifuge comprises a separating drum outfitted with an inlet for introduction of the feed, an outlet for specifically heavier liquid, an outlet for specifically lighter liquid, and an outlet for the solids component. Each of the feed inlet, the outlet for specifically heavier liquid, and the outlet for the solids component is provided with a valve. The solids outlet valve is fluid controlled for being in the closed position during normal centrifuging and in the open position when solids are to be discharged, and there is a control fluid line for transfer of fluid for control of the solids outlet valve. A valve is installed in the control fluid line. The invention provides a control unit effective, following actuation thereof, to operate the valve for the outlet for specifically heavier liquid to reduce the flow of specifically heavier liquid, and, after a fixed time interval, to operate the valve in the control fluid line for transfer of fluid to the fluid control valve for opening of the solids outlet valve for discharge of the solids, and, also following actuation of the control unit, to operate the valve in the feed line to shut off the flow of feed to the centrifuge. Thereby, as long as valve 19 is open specifically lighter liquid can be displaced from the centrifuge via the outlet for specifically lighter liquid before the solids component is discharged.

The centrifuge can further comprise an inlet outfitted with a valve for introducing a foreign liquid specifically heavier than said specifically lighter liquid, into the feed inlet downstream of the feed inlet valve. The control unit is then effective to close the feed inlet valve and open the foreign liquid valve for displacement of the specifically lighter liquid by the foreign liquid, prior to the operating of the valve in the control fluid line.

What is claimed is:

1. A self-emptying centrifuge suitable for separating a feed material into a specifically heavier liquid, a specifically lighter liquid, and a solids component, comprising:

a separating drum outfitted with an inlet for introduction of the feed, an outlet for specifically heavier liquid, an outlet for specifically lighter liquid, and an outlet for the solids component, each of the feed inlet, the outlet for specically heavier liquid, and the outlet for the solids component being provided with a valve, means for actuating the solids outlet valve to open and close it for being in the closed position during normal centrifuging and in the open position when solids are to be discharged, and a control unit effective following actuation thereof to operate the valve for the outlet for specifically heavier liquid to reduce the flow of specifically heavier liquid and after a fixed time interval to operate said means for actuating the solids outlet valve for opening of the solids outlet valve for discharge of the solids, and also following actuation of the control unit, to operate the valve in the feed line to shut off flow of feed to the centrifuge, whereby as long as the valve in the feed line is open specifically lighter can be displaced from the centrifuge via the outlet for specifically lighter liquid before the solids component is discharged.

2. Centrifuge according to claim 1, and an inlet outfitted with a valve for introducing a foreign liquid specifically heavier than said specifically lighter liquid, into the feed inlet downstream of the feed inlet valve, said control unit being effective to close the feed inlet valve and open the foreign liquid valve for displacement of said specifically lighter liquid by the foreign liquid prior to the operating said means for actuating the solids outlet valve.

3. Centrifuge according to claim 2, wherein said means for actuating the solids outlet valve comprises a fluid operated control means including a control fluid line for transfer of fluid for control of the solids outlet valve and a valve in the control fluid line, the control unit, for said operating of the said means for actuating the solids outlet valve, operating the valve in the fluid control line.

4. Centrifuge according to claim 1, wherein said means for actuating the solids outlet valve comprises a fluid operated control means including a control fluid line for transfer of fluid for control of the solids outlet valve and a valve in the control fluid line, the control unit, for said operating of the said means for actuating the solids outlet valve, operating the valve in the fluid control line.

* * * * *

UNITED STATES PATENT OFFICE

CERTIFICATE OF CORRECTION

PATENT NO. : 3,938,734

DATED : February 17, 1976

INVENTOR(S) : Friedrich Wilke

It is certified that error appears in the above-identified patent and that said Letters Patent are hereby corrected as shown below:

1. Column 5, line 12, change "specically" to --specifically--.

2. Column 5, line 28, after "lighter" insert --liquid--.

Signed and Sealed this

Fourteenth Day of December 1976

[SEAL]

*Attest:*

RUTH C. MASON
*Attesting Officer*

C. MARSHALL DANN
*Commissioner of Patents and Trademarks*